US008858725B2

(12) United States Patent
Mailänder

(10) Patent No.: US 8,858,725 B2
(45) Date of Patent: Oct. 14, 2014

(54) WASHING ITEMS SUPPORT FOR A DISHWASHER

(75) Inventor: Hans Mailänder, Heidenheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 2029 days.

(21) Appl. No.: 11/667,718

(22) PCT Filed: Oct. 17, 2005

(86) PCT No.: PCT/EP2005/055299

§ 371 (c)(1),
(2), (4) Date: Oct. 1, 2007

(87) PCT Pub. No.: WO2006/056515

PCT Pub. Date: Jun. 1, 2006

(65) Prior Publication Data

US 2008/0169009 A1 Jul. 17, 2008

(30) Foreign Application Priority Data

Nov. 25, 2004 (DE) ..... 10 2004 057 018

(51) Int. Cl.
*B08B 3/00* (2006.01)
*A47L 15/50* (2006.01)

(52) U.S. Cl.
CPC ..... *A47L 15/502* (2013.01); *A47L 15/505* (2013.01)
USPC ..... 134/56 D; 211/41.8

(58) Field of Classification Search
CPC ..... A47L 15/50; A47L 15/505; A47L 15/502
USPC ..... 134/56 D, 57 D, 58 D; 220/487, 488; 312/228.1; 211/41.8, 181.1
See application file for complete search history.

(56) References Cited

U.S. PATENT DOCUMENTS

| | | | | |
|---|---|---|---|---|
| 5,211,189 | A * | 5/1993 | Santarossa | 134/179 |
| 5,345,959 | A * | 9/1994 | Matteson | 134/201 |
| 6,109,455 | A * | 8/2000 | Schroeder | 211/41.9 |
| 6,546,942 | B2 * | 4/2003 | Smith et al. | 134/201 |
| 2004/0108283 | A1 * | 6/2004 | Miilu et al. | 211/41.9 |
| 2005/0028847 | A1 | 2/2005 | Kaczmarek | |

FOREIGN PATENT DOCUMENTS

| | | |
|---|---|---|
| DE | 43 09 915 | 9/1994 |
| DE | 296 18 924 U | 2/1998 |
| DE | 198 23 808 | 12/1999 |
| EP | 0 186 157 A1 | 7/1986 |

(Continued)

OTHER PUBLICATIONS

Machine Translation of Steiner et al., DE 19823808, Dec. 1999.*

(Continued)

*Primary Examiner* — David Cormier
(74) *Attorney, Agent, or Firm* — James E. Howard; Andre Pallapies

(57) ABSTRACT

A washing items support assembly for a dishwasher supports items of cutlery for washing that have been laid in a first cutlery container arranged in a first container region and supports other washing items in a second container region in which at least one washing items holder is arranged in which, optionally, pieces of cutlery or other crockery pieces may be laid as washing items, whereby the washing items holder has a support surface for the washing items which is or may be inclined relative to the horizontal.

24 Claims, 2 Drawing Sheets

(56) References Cited

FOREIGN PATENT DOCUMENTS

Figure 1:
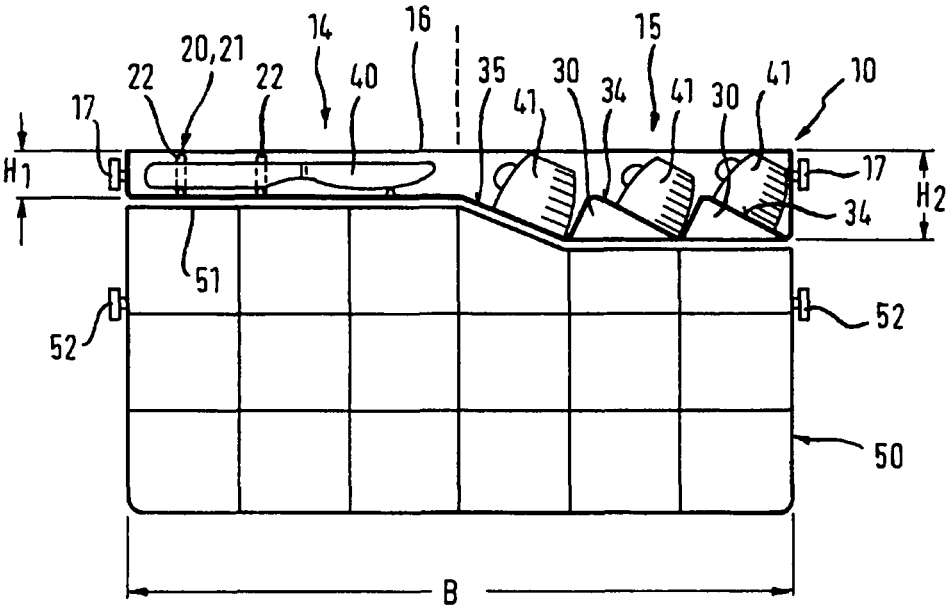

| | | | |
|---|---|---|---|
| EP | 0 186 157 | B1 | 7/1986 |
| EP | 1127532 | A2 * | 8/2001 |
| EP | 1 275 336 | | 1/2003 |
| JP | 2001-190481 | | 7/2001 |
| WO | WO 2005041744 | A1 * | 5/2005 |

OTHER PUBLICATIONS

Machine Translation of Yura et al., JP 2001-190481, Jul. 2001.*
International Search Report PCT/EP2005/055299.

* cited by examiner

WASHING ITEMS SUPPORT FOR A DISHWASHER

The invention relates to a washing items support for a dishwasher. The invention further relates to a dishwasher with a suitably designed washing items support.

DE 43 09 915 A1 discloses a washing items support described as a cutlery basket insert which can be fitted to a cutlery basket displaceably mounted in a cutlery container of the dishwasher. The washing items support is provided with holders on both sides with which the cutlery basket insert can be coupled to the cutlery basket. The cutlery basket insert extends in this case from an upwardly directed lateral wall to the opposite lateral wall running parallel with it, so that washing items, e.g. pieces of cutlery and other long-handled items, can be arranged in this manner. The term "lateral wall" may also refer to the front wall of the cutlery basket and correspondingly to the rear wall of the cutlery basket, viewed by the device user when the dishwasher is open. The washing items support may in principle also be used for depositing large area, flat bottom washing items, e.g. cups, small bowls, glasses and the like.

However, the fact that the cutlery to be washed can be placed largely unsorted, and in a randomly flat position for washing in the cutlery basket must be regarded as a disadvantage. Because of this, and due to the mechanical action of the water during washing, there is mutual contact between the individual pieces of cutlery during the washing process, producing shadow zones during washing, which means that the cutlery cannot be perfectly washed at each point of contact or in each shadow zone. This applies in particular to spoons placed one on top of the other. A further disadvantage may be seen when water accumulates preferably in the lips of the spoons and the like, which water can only be removed by supplying a great deal of thermal energy during drying of the cutlery after washing because the water has been unable to run off. In this case, however, undesirable water or drying stains are generally left behind on the items of cutlery.

DE 296 18 924 U1 therefore proposes that a support surface be arranged on a cutlery basket which can be locked so that it can be swivelled at least partially about a horizontal axis at different angles of inclination. This provides a surface for placing alternately both long handled and low, flat washing items, enabling them to be both washed and dried extremely effectively. The support surface may be adjusted by locking at different angles of inclination for arranging corresponding washing items. Thus when the support surface is used for long handle washing items (pieces of cutlery), a horizontal arrangement will be provided. Because of the uniform distribution of the washing items on the support surface, without their rolling or sliding over one another, this does not however guarantee an optimum washing and drying result because the same disadvantages as described above are found there.

A better washing and drying result is provided by dishwashers in which a cutlery basket is arranged so that it can be pulled out of the washing space.

By providing a cutler container in the cutlery basket it is possible to arrange the individual pieces of cutlery so that they are sorted, thereby improving the cleaning result whilst saving energy.

Such a washing items support is disclosed in EP 0 186 157 B1. The proposed cutlery containers, in the form of cutlery holders and cutlery supports, enable the pieces of cutlery to be received individually on each side. This prevents the formation of accumulations of water in the spoon lips or the like because of the cutlery lying on its side during washing and drying and not mutually touching. The washing water is able to run off the pieces of cutlery unhindered and without residue, so that only the desired thin film of water remains on the cutlery surface after washing, which is able to evaporate quickly and without major energy expenditure and without stains during the drying process. This can also considerably shorten the drying programme time. However, the disadvantage of the washing items support described in this publication is its inflexibility when filling the same, since the cutlery containers are optimised in terms of sorting pieces of cutlery, such as knives, forks, spoons and the like. Pieces of cutlery such as meat forks, cooking spoons, salad cutlery and the like must, however, be laid randomly flat for washing in the cutlery basket.

The object of the invention is to indicate a washing items support which is universally applicable, allows simple, convenient sorting of pieces of cutlery and other washing items, and in doing so provides an excellent washing and drying result.

The object established is achieved according to the invention by a washing items support with the features of claim 1 and a dishwasher with the features of claim 10.

Advantageous designs are evident from the dependent claims.

The washing items support according to the invention for a dishwasher comprises a first container region designed as a cutlery container, on which pieces of cutlery can be placed horizontally, a second container region for washing items, e.g. cups, small bowls, shallow glasses or pieces of cutlery, with at least one washing items holder, whereby the at least one washing items holder has a support surface that is inclined or can be inclined to the horizontal, for the washing items, and whereby the first container region and the second container region lie essentially in one horizontal plane.

The washing items support therefore represents a kind of cutlery drawer which is arranged in addition to the crockery baskets provided in the dishwasher. In contrast to the state of the art, the washing items support according to the invention enables smaller containers to be received in addition to pieces of cutlery, which containers can be effectively dried because of the support surface inclined to the horizontal. The washing items support therefore represents a multi-purpose cutlery drawer. Whilst the first container region is classically designed for the ordered receiving of pieces of cutlery, it design of the second container region enables both pieces of cutlery and other pieces of crockery to be placed in it.

In an additional design the first container region has cutlery containers in the form of cutlery holders and cutlery supports for the individual receiving, preferably on one side, of pieces of cutlery, the container region preferably being essentially horizontal. This enables the pieces of cutlery to be positioned so that the washing washer is able to run off unhindered.

In one design of the invention at least two washing items holders are provided in the second container region of the washing items support, the contact surface of which holders run preferably parallel to each other. Because of the provision of upper sections in each washing items holder support points are created for pieces of cutlery placed in the second container region.

In a further design a multiplicity of second cutlery containers are integrated in the washing items holder or washing items holders so that the pieces of cutlery arranged in the second container region, supported by the second cutlery containers, can be arranged perpendicularly to the longitudinal extension of the contact surface of the washing items container. For example, the second cutlery containers form cutlery supports and cutlery holders. This can be achieved, for example, by profiling the upper sections of the washing items holders. The contact surfaces provided by the washing items holders may also be used for receiving pieces of cutlery in the second container region, thus enabling the pieces of cutlery to be placed on these surfaces only loosely and in no particular order in the direction of the support surfaces. However, the use of the second cutlery containers integrated in the washing items holders is more appropriate because they allow sorted receiving of the pieces of cutlery, since these perpendicular support surfaces of the washing items holder are arranged therein.

In one suitable design the washing items support in the second container region is higher than that in the first container region, the loading side of the washing items support lying in one plane. The greater height in the second container region enables cups and smaller bowls to be placed therein without projecting from the loading side of the washing items support. This enables the washing items support to be arranged directly underneath the container roof or below a crockery basket, thus saving space.

In a further design the washing items support is mounted in the dishwasher so that it can be removed, the first and second container regions each being arranged in their longitudinal extension parallel to the insert device of the washing items support. The washing items support can therefore be pulled out independently of the further crockery baskets provided in the dishwasher. This allows simple loading of the washing items support. The arrangement of the first and second container regions, in their longitudinal extension, parallel to the insert device, allows optimum use of the container volume of the washing space, since a suitably designed crockery basket of the dishwasher can be installed immediately underneath the washing items support.

The first and second container regions suitably extend over the entire depth of the washing items support.

In a further design the washing items support has a base basket comprising a surrounding wire frame and wires running transversely or longitudinally to the direction of insertion, where the first cutlery containers and the at least one washing items holder are releasably secured as inserts to the base basket, or the washing items holder has its own independent extraction mechanics. The cutlery containers and washing items holders may in this case be supported on the wires of the wire frame. The advantage of separate extraction mechanics is that the washing items support according to the invention can be pulled out of the washing items container independently of the base basket.

Here the first container containers and the at least one washing items holder are suitably of an integral design and are manufactured from a plastic with a course mesh. Their production from a plastic enables them to be easily fastened to the washing items support by suitably shaped stop connections. Obviously the insert for the first cutlery container and the insert for the washing items holders may also be separately constructed. The washing goods holders are preferably of integral design, but it is also easily possible to fasten individual washing goods holders releasably in the second container region in the wire frame.

Figure 2:
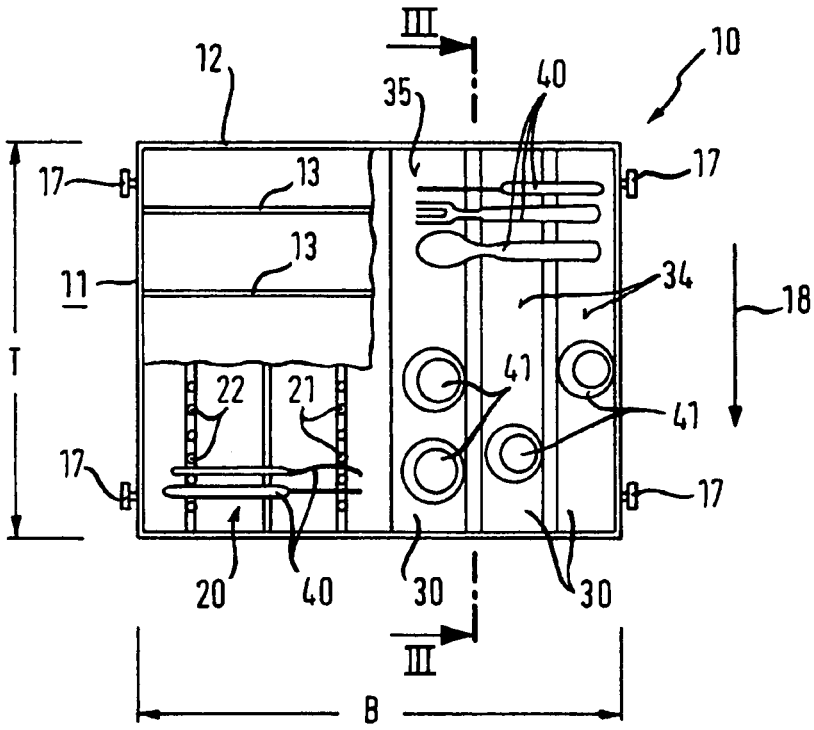
Figure 3:
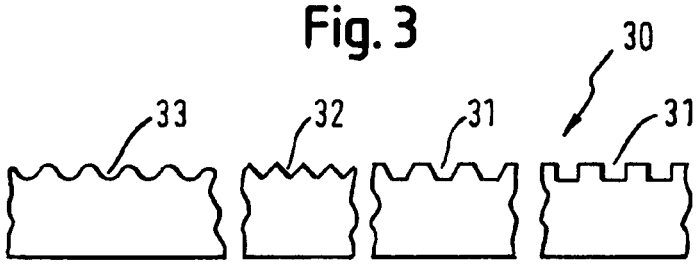

Further advantages and designs of the invention are explained in greater detail in the following with reference to the figures, where:

FIG. 1 shows a washing items support arranged above a cutlery basket in a sectional representation, FIG. 2 shows an elevation of a washing items support according to the invention, and FIG. 3 shows a section through the washing items holder shown in FIG. 2.

FIG. 1 shows a washing items support 10 according to the invention, which is preferably arranged above a crockery basket 50, any arrangement in the washing space of a dishwasher being possible. The sectional representation shows the arrangement from the side, as a user of the dishwasher sees it when opening the door. Washing items support 10 is divided into a first container region 14 and a second container region 15, each of them occupying approximately half width B of washing items support 10. This division is purely arbitrary and any other division could be selected. First container region 14 and second container region 15 are preferably arranged essentially in one plane.

In first container region 14 is arranged a cutlery insert 20 which has, for example, first cutlery containers 21 and cutlery holders 22. Because of this it is possible to arrange pieces of cutlery 40 sorted, lying one next to the other, in the first container region throughout the depth of washing items support 10. In addition to the knife shown in the figure, forks, spoons and other pieces of cutlery may also be placed in the container region. The exact design of cutlery insert 20 is of subordinate importance to the essential concept of the invention. For example, the cutlery insert could be designed as in EP 0 186 157 B1 described in the introduction, but it could also be designed in any other manner. Washing items support 10 has a height H1 along first container region 14.

In a second container region 15 washing items support 10 is designed to receive smaller washing items, e.g. cups, shallow glasses, dessert bowls, or alternatively cutlery in the transverse and longitudinal directions, long knifes, cooking spoons etc. For this purpose second container region 15 is provided, for example, with two washing items holders 30, each of which has a support surface 34 inclined to the horizontal. The pieces of crockery are placed in an oblique position on support surfaces 34, as shown in the figure, so that the drying process is facilitated by the runoff of the water into hollows in the pieces of crockery. The washing items holders and cutlery insert may be manufactured from a plastic. Both elements mentioned may be formed integrally together or they may be provided as separate inserts. All washing items holders 30 are in this case open, in the manner of course meshes, for optimum washing of the crockery. The inclination of support surface 34 of washing goods holder 30 may also be adjustable, e.g. in that washing items older 30 can be swivelled and stopped about a horizontal axis (not shown).

Washing items support 10 has a base basket 11 produced from a surrounding wire frame 12, a few base wires 13 running continuously in the transverse or longitudinal direction being located in its base region. Washing items holders 30, designed as inserts, and the cutlery insert, are releasably inserted in this base basket, the connection being made by a stop in the wire frame. Washing items holders 30, as inserts, preferably consist of plastic. The inserts are supported on continuous bottom wires 13, which are also more clearly shown in FIG. 2. Washing items support 10 therefore consist of a base basket 11 and a washing items holder 30 of plastic. In a further embodiment, not shown, washing items support 10 may consist of only one material, e.g. plastic, i.e. without base basket 11.

To ensure that the washing items, in particular pieces of crockery 41, do not project from loading side 16, washing items support 10 has, in the second container region, a height H2 which is greater than height HI. The transition region between height H2 and height H1, which is assigned to the second container region, functionally represents a support surface 35. Transition region 35 may in this case represent an integral part of the adjacent washing items holder 30 or of the insert comprising all the washing items holders 30. The bottom end of first container region 14 is higher in the vertical direction than the bottom end of second container region 15 in the vertical direction. This height arrangement may also be reversed or provided in any other constellation of the same, e.g. with the bottom end of the first and second container regions 14, 15 having the same height.

Both washing items support 10 and crockery basket 50 are mounted by a known method by means of extraction mechanics, washing items support 10 and crockery basket 50 each being provided on both sides with a plurality of fastening means 17 and 52 respectively, forming part of the extraction mechanics. The fastening means may, for example, be rotatably mounted wheels. The direction of movement of the washing items support in operation is denoted by the arrow with the reference number 18 (FIG. 2). Furthermore, washing items support 10 according to the invention cannot be fastened to a crockery basket 50 either and has its own independent extraction mechanics.

FIG. 2 shows an elevation of the washing items support in which an exemplary arrangement of pieces of cutlery 40 in first container region 14, and an exemplary arrangement of pieces of crockery 41 and pieces of cutlery 40 in second container region 15, are represented. As described, a cutlery insert 20, which enables pieces of cutlery 40 to be filled sorted, is arranged in first container region 14, so that can be loaded with a sufficient quantity of washing fluid without washing shadows. To facilitate drying of the pieces of cutlery 40 they are secured horizontally by means of cutlery holders 22 on the side.

Only a part of cutlery insert 20 is shown by way of illustration, so that the mounting of the coarse-meshed cutlery insert 20 on wire 13 of base basket 11 extending in the transverse direction can be seen. Although this is not evident from the representation, wires 13 extend over the entire width of washing items support 10, so that washing items holder 30 can also be supported on them.

Pieces of crockery 41, which are represented in the figure by cups and small bowls, are sorted by a known method. As shown more clearly in FIG. 3, the upper sections of washing items holder 30 can also be provided with second cutlery containers 31, 32, 33, which allow pieces of cutlery 40 to be sorted perpendicularly to support surfaces 34, 35 of washing items holder 30. There are no particular requirements regarding the design of the second cutlery containers as long as it is ensured that pieces of cutlery mounted in the recesses are protected from sliding in the direction of insertion 18. As shown, the second cutlery containers may be designed in the shape of a trapezium, zigzag, wave or rectangle. The formation of projections and elevations in the upper sections of washing items holders 30 is also conceivable. The design of washing items support 10 according to the invention obviously also enables extremely long pieces of cutlery to be placed on the washing items holders along the support surfaces.

The washing items holder according to the invention allows universal usability and provides optimum drying of the washing items. Washing items support 10 is preferably arranged above the upper cutlery basket in a dishwasher, as the temperatures in the drying process are highest there. Because of the possibility of pulling the washing items support out of the washing space of the dishwasher, convenient loading and unloading are guaranteed. Due to universal usability the user of shelves in the upper crockery basket of the dishwasher may be dispensed with. Cutlery basket 50 may in this case be arranged underneath washing items support 10, as shown in FIG. 1, the course of loading side 51 being adapted to the lower side of washing items support 10.

LIST OF REFERENCE SYMBOLS

10 Washing items support
11 Base basket
12 Surrounding wire frame
13 Bottom wire
14 First container region
15 Second container region
16 Loading side
17 Fastening means
18 Direction of movement of the washing items support
20 Cutlery insert
21 Cutlery container
22 Cutlery holder
30 Washing items holder
31 Cutlery container
32 Cutlery container
33 Cutlery container
34 Support surface
35 Support surface
40 Piece of cutlery
41 Piece of crockery
50 Crockery basket
51 Loading side
52 Fastening means
T Depth
$H_1$, $H_2$ Height
B Width

The invention claimed is:

1. A washing items support assembly for a dishwasher, the washing items support assembly comprising:

a first container region configured to receive pieces of cutlery disposed thereon in a generally horizontal disposition, the first container region being substantially horizontal and having a first maximum depth from a top of the washing items support assembly, and the first container region extending between two opposed sides of the washing items support assembly and from a side adjacent to the opposed sides to an intermediate point of the two opposed sides; and a second container region for washing items having at least one washing items holder having a support surface for supporting a washing item at an inclination to horizontal, the second container region having a second maximum depth from a top of the washing items support assembly, the second maximum depth occurring at a plurality of discrete locations along a first edge of the support surface, wherein the first maximum depth is less than the second maximum depth, the first maximum depth occurs at a plurality of lower-most surfaces that are separated from one another by higher intermediate surfaces, the plurality of lower-most surfaces and the higher intermediate surfaces together are adapted to retain the pieces of cutlery adjacent to but spaced apart from one another in a generally parallel disposition, and the first container region and the second container region are locationally fixed with respect to the washing items support assembly.

2. The washing items support assembly according to claim 1, wherein the first container region is provided with cutlery containers in the form of cutlery holders and cutlery supports for receiving individual pieces of cutlery.

3. The washing items support assembly according to claim 1, wherein at least two washing items holders are provided in the second container region and the support surfaces of the washing items holders extend essentially parallel to each other.

4. The washing items support assembly according to claim 1, wherein a plurality of second cutlery containers is integrated in the at least one washing items holder so that the pieces of cutlery arranged in the second container region, supported by the second cutlery containers, can be arranged perpendicularly to a longitudinal extension of a support surface of the at least one washing items holder.

5. The washing items support assembly according to claim 1, wherein the second container region is adapted to accommodate washing items with a greater height than the first container region and a second edge of the support surface and the first maximum depth lie substantially in one plane.

6. The washing items support assembly according to claim 1, wherein the washing items support is removably mounted in the dishwasher and the first and second container regions are arranged in their respective longitudinal extensions parallel to an insertion direction of the washing items support assembly into a dishwasher.

7. The washing items support assembly according to claim 1, wherein the first and second container regions extend over the entire width of the washing items support assembly.

8. The washing items support assembly according to claim 1, wherein the first container region includes first cutlery containers and the first cutlery containers and the at least one washing items holder are designed integrally and are formed from a plastic in a coarse-meshed manner.

9. The washing items support assembly according to claim 1, wherein a plurality of discrete locations along a second edge of the support surface and the first maximum depth lie substantially in one plane.

10. The washing items support assembly according to claim 9, wherein the plurality of discrete locations along the second edge provide locations in the second container region that are adapted to receive pieces of cutlery disposed thereon in a generally horizontal disposition.

11. The washing items support assembly according to claim 10, further comprising a second support surface parallel to and laterally offset from the support surface, the second support surface including a second plurality of discrete locations along an edge of the second support surface adapted to receive pieces of cutlery disposed thereon and hold the pieces of cutlery in a substantially horizontal manner in cooperation with the plurality of discrete locations along the second edge.

12. The washing items support assembly according to claim 1, wherein the generally parallel disposition is generally perpendicular to the first edge of the support surface.

13. The washing items support assembly according to claim 1, wherein the first container region and the second container region are adapted to receive the pieces of cutlery and the washing item, respectively, through a common opening in the washing items support assembly.

14. The washing items support assembly according to claim 1, wherein the first container region and the second container region are part of at least one insert and the first container region and the second container region are locationally fixed with respect to the washing items support assembly when the insert is inserted into the washing items support assembly.

15. A washing items support assembly for a dishwasher, the washing items support assembly comprising:

a first container region configured to receive pieces of cutlery disposed thereon in a generally horizontal disposition, the first container region being substantially horizontal and having a first maximum depth from a top of the washing items support assembly, and the first container region extending between two opposed sides of the washing items support assembly and from a side adjacent to the opposed sides to an intermediate point of the two opposed sides; and a second container region for washing items having at least one washing items holder having a support surface for supporting a washing item at an inclination to horizontal, the second container region having a second maximum depth from a top of the washing items support assembly, the second maximum depth occurring at a plurality of discrete locations along a first edge of the support surface, wherein the first maximum depth is less than the second maximum depth, wherein the first maximum depth occurs at a plurality of lower-most surfaces that are separated from one another by higher intermediate surfaces, the plurality of lower-most surfaces and the higher intermediate surfaces together are adapted to retain the pieces of cutlery adjacent to but spaced apart from one another in a generally parallel disposition, and wherein the washing items support assembly has a base basket comprising a surrounding wire frame and wires running transversely or longitudinally to the direction from which items are inserted in the base basket, and the first container region comprises a cutlery container releasably fastened to the base basket as an insert and the at least one washing items holder is a selected one of releasably fastened to the base basket as an insert and fastened via its own independent extraction mechanics.

16. A dishwasher comprising:

a washing space that can be sealed by a door, the washing space having at least one spraying device and at least one removable crockery basket therein; and a washing items support assembly disposed in the washing space, the washing items support assembly comprising:

a first container region configured to receive pieces of cutlery disposed thereon in a generally horizontal disposition, the first container region being substantially horizontal and having a first maximum depth from a top of the washing items support assembly, and the first container region extending between two opposed sides of the washing items support assembly and from a side adjacent to the opposed sides to an intermediate point of the two opposed sides, and a second container region for washing items having at least one washing items holder having a support surface for supporting a washing item at an inclination to horizontal, the second container region having a second maximum depth from a top of the washing items support assembly, the second maximum depth occurring at a plurality of discrete locations along a first edge of the support surface, wherein the first maximum depth is less than and the second maximum depth, the first maximum depth occurs at a plurality of lower-most surfaces that are separated from one another by higher intermediate surfaces, the plurality of lower-most surfaces and the higher intermediate surfaces together are adapted to retain the pieces of cutlery adjacent to but spaced apart from one another in a generally parallel disposition, and the first container region and the second container region are locationally fixed with respect to the washing items support assembly.

17. The dishwasher according to claim 16, wherein the washing items support assembly is adapted to pull out of the washing space.

18. The dishwasher according to claim 16, wherein the washing items support assembly is installed above a crockery basket and the external dimensions of the crockery basket are adapted to conform to a lower profile of the washing items support assembly.

19. The dishwasher according to claim 16, wherein a plurality of discrete locations along a second edge of the support surface and the first maximum depth lie substantially in one plane.

20. The dishwasher according to claim 19, wherein the plurality of discrete locations along the second edge provide locations in the second container region that are adapted to receive pieces of cutlery disposed thereon in a generally horizontal disposition.

21. The dishwasher according to claim 20, further comprising a second support surface parallel to and laterally offset from the support surface, the second support surface including a second plurality of discrete locations along an edge of the second support surface adapted to receive pieces of cutlery disposed thereon and hold the pieces of cutlery in a substantially horizontal manner in cooperation with the plurality of discrete locations along the second edge.

22. The dishwasher according to claim 16, wherein the generally parallel disposition is generally perpendicular to the first edge of the support surface.

23. The dishwasher according to claim 16, wherein the first container region and the second container region are adapted to receive the pieces of cutlery and the washing item, respectively, through a common opening in the washing items support assembly.

24. The dishwasher according to claim 16, wherein the first container region and the second container region are part of at least one insert and the first container region and the second container region are locationally fixed with respect to the washing items support assembly when the insert is inserted into the washing items support assembly.

* * * * *